United States Patent [19]

Varlet et al.

[11] Patent Number: 4,457,438

[45] Date of Patent: Jul. 3, 1984

[54] TAMPERPROOF CLOSURE

[75] Inventors: Hubert Varlet, Paris; Aurel Catalogna, Aulnav-Sous-Bois, both of France

[73] Assignee: Boussois Souchon Neuvesel Gervais Danone, Paris, France

[21] Appl. No.: 480,115

[22] Filed: Mar. 29, 1983

[30] Foreign Application Priority Data

Mar. 31, 1982 [FR] France ..... 82 05891

[51] Int. Cl.[3] ..... B65D 41/34

[52] U.S. Cl. ..... 215/252

[58] Field of Search ..... 215/252

[56] References Cited

U.S. PATENT DOCUMENTS 2,915,211 12/1959 Ryan ..... 215/252

FOREIGN PATENT DOCUMENTS 2291915 6/1976 France ..... 215/252

*Primary Examiner*—Donald F. Norton

*Attorney, Agent, or Firm*—Karl F. Ross; Herbert Dubno

[57] ABSTRACT

A tamperproof closure comprises a cap which is surrounded by a sleeve, the latter having a ring which is separated upon opening of the closure to signal such opening. The sleeve is provided with grooves receiving ribs on the outer surface of the cap, the ribs being flanked by shoulders of the sleeve to axially couple the two members together. The cap provides the seal for the neck of the container and both members can be separately molded from synthetic resin.

12 Claims, 3 Drawing Figures

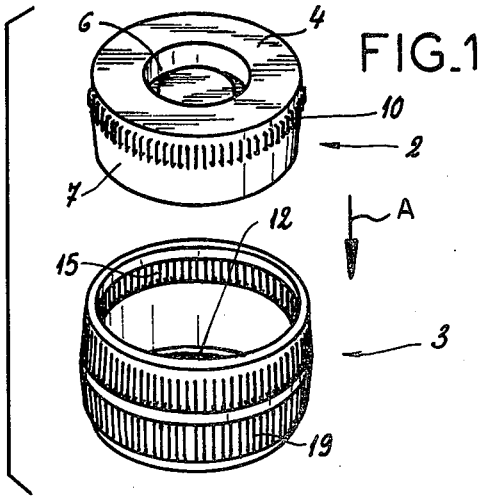
FIG. 1
FIG. 2
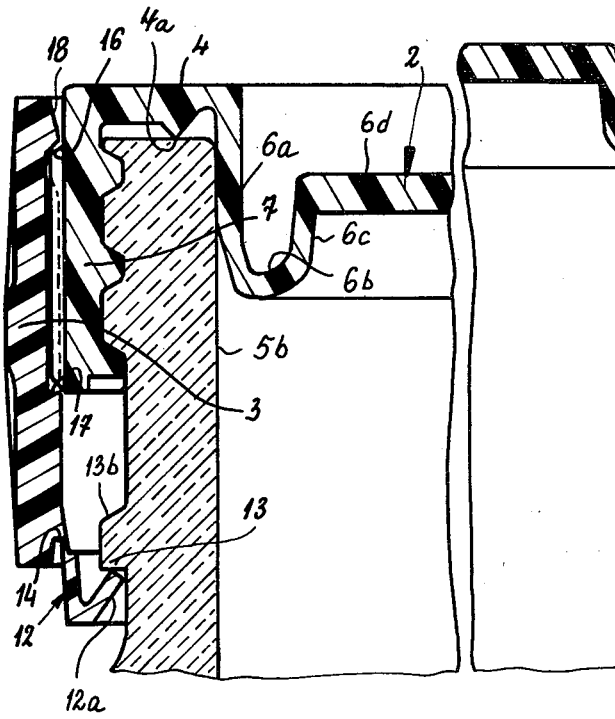
FIG. 3
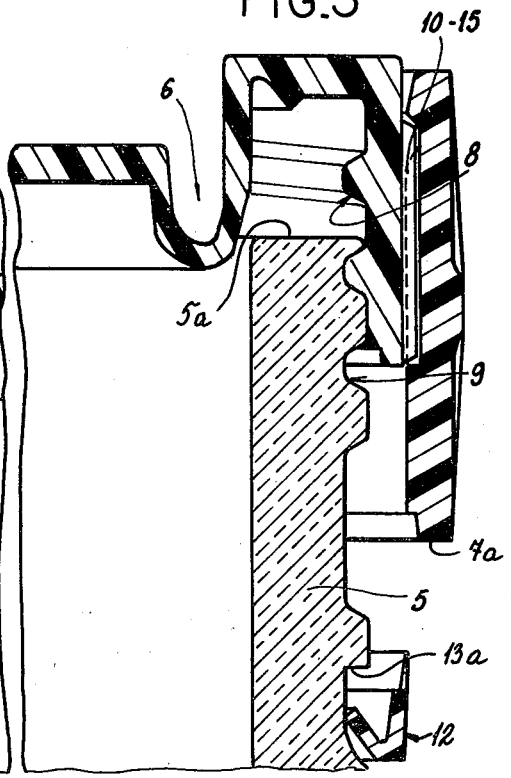

TAMPERPROOF CLOSURE

FIELD OF THE INVENTION

Our present invention relates to a tamperproof closure and, more particularly, to a safety closure of the screw, bayonet or snap type, capable of signaling any tampering with the closure or the prior opening of the container.

BACKGROUND OF THE INVENTION

For a number of products it has become increasingly important to be able to package them in so-called tamperproof containers, i.e. containers which can be delivered to the purchaser or the consumer in a form providing security to the user against prior opening of the container or a tell-tale signal of such unauthorized access to the contents. Closures for screw-type containers for this purpose generally comprise a ring, which can be termed a security ring, whose separation from the closure bears witness to the fact that the container has been opened.

Tamperproof containers providing such security can be in the form of cans, bottles or flasks, and the tamperproof closure may be provided for safety or health reasons, or simply to assure the consumer that there has been no adulteration or substitution of the contents.

Tamperproof containers may be used for combustibles, for pharmaceuticals, for cosmetics, for alcoholic beverages and even for a variety of industrial liquids for safety purposes. In addition, such closures serve as guarantees of the quantity and quality of the contents.

It is known, as noted, to provide a screw-type closure with a safety ring connected to the body of the closure by a readily rupturable web or by other ligatures so that, when the closure is unscrewed for the first time, this ring engages a shoulder on the neck of the container and is held back as the remainder of the closure is withdrawn, thereby rupturing the web and separating the ring from the body of the closure.

The first opening of the container thus results in such separation and the separation of the ring can be immediately noted by any subsequent user or by the consumer and will be associated with some type of tampering with the closure. When the closure is formed from a synthetic resin material, it is difficult to provide it in one piece with the ring and at the same time ensure perfect sealing of the container mouth. The problems involved include sealing, tight fitting of the closure and engagement of the ring over the collar, conditions which may not be mutually compatible in earlier devices, especially where perfect sealing is required in the pharmaceutical industry.

It is not uncommon, therefore, to make a closure for such purposes from three pieces, namely, one piece which has as its primary function the formation of a seal, another piece whose primary function is that of a holder for the seal, and a third piece which cooperates with the holder and whose primary function is that of a carrier of the ring. In general, therefore, prior-art tamperproof closures especially for systems in which a high degree of sealing is mandatory, have been complex, difficult to use, and expensive to manufacture and mount upon the container.

OBJECTS OF THE INVENTION

It is the principal object of the present invention to provide a tamperproof closure whereby these disadvantages are obviated.

Another object of the invention is to provide a two-piece closure for the purposes described fabricated from synthetic resin material, which is simple to assemble and can readily be mounted upon the container.

Another object of the invention is to provide a low-cost highly effective sealing closure of the tamperproof type.

SUMMARY OF THE INVENTION

These objects and others which will become apparent hereinafter are attained, in accordance with the present invention, which provides a tamperproof closure having a cylindrical outer member in the form of a sleeve or skirt adapted to surround the neck of a container and formed unitarily with a safety ring at its lower axial end, this ring being connected by at least one frangible web or by at least one rupturable ligature to the bottom or lower end of the sleeve or skirt. The inner member is formed as a cap adapted to fit over the mouth of the container and comprising an outer cylindrical portion disposed between the sleeve or skirt and the neck of the container and formed internally with means, e.g. a screw thread or bayonet ribs, adapted to engage the neck of the container so that with relative rotation of the container, neck and the cap, the cap may be tightened or loosened. The cap is also formed, at its bottom or end, with sealing means engageable with the mouth of the container to provide the desired seal.

According to the invention, the outer surface of the outer member of the cap and the inner surface of the skirt or sleeve are formed with mating grooves or ribs extending longitudinally so that the longitudinal grooves of the sleeve engage the longitudinal ribs of the cap and provide angular coupling between the two between a pair of shoulders engaging the ribs on opposite axial ends and turned toward the interior.

Thus, as the assembly is rotated by gripping the deformable outer sleeve or skirt, the screw thread causes the cap to rise on the neck of the container, the ribs bear upon the upper internal shoulder of the sleeve, the sleeve is entrained upwardly and the telltale safety ring caused to engage the underside of a shoulder or collar on the neck of the retainer and is contained or held back, thereby rupturing the frangible web and separating the ring from the skirt.

If desired, the skirt or sleeve can be removed for further use of the cans although it is preferable to leave the sleeve or skirt in place for tightening or loosening the cap which skirt can be deformed into an oval configuration when it is squeezed against the cap.

Assembly of the two elements is effected by inserting the cap into the sleeve or skirt at its end opposite the end provided with the ring. The axial retention of the cap in the skirt or sleeve is achieved by the engagement of the ribs of the cap between the aforementioned shoulders of the skirt and the angular or rotational coupling of the two elements is achieved by the engagement of the ribs in the complementary grooves of the skirt and sleeve.

The assembly can be then threaded onto the container or the assembly can be forced thereon, with the ring passing over the shoulder of the neck of the container. With the first attempt to open the container, the telltale ring will detach.

The device of the invention is comparatively simple since it is comprised of only two pieces and affords excellent sealing at the same time that it is capable of signaling tampering.

This is especially the case when the cap is formed with an inwardly extending flexible lip in the manner of a double-lip seal which hugs the inner wall of the container. The skirt or sleeve facilitates opening of the container since it provides a deformable member which is rotationally coupled with the cap and easily gripped by the user while being deformable into the oval configuration as noted. The outer surface of the skirt of sleeve can be marked, milled, grooved or ribbed, to permit such gripping.

At its end remote from the ring, the skirt or sleeve can be internally chamfered to permit insertion of the cap into the sleeve.

BRIEF DESCRIPTION OF THE DRAWING

The above and other objects, features and advantages of the present invention will become more readily apparent from the following description, reference being made to the accompanying drawing in which:

FIG. 1 is an exploded view in a perspective of the closure of the present invention;

FIG. 2 is a partial axial section showing the closure in place on a neck of the body; and FIG. 3 is a view similar to FIG. 2 but showing the removal of the closure for the first time, i.e. the initial opening of the device.

SPECIFIC DESCRIPTION

In FIG. 1, we have shown two independently injection molding synthetic resin members 2 and 3 of the closure of the present invention. These members are a cap 2 and a skirt or sleeve 3. The latter is cylindrical and is adapted to receive the cap which can be inserted in the direction of the arrow A into the sleeve.

The cap 2 is a cup-shaped member formed at its bottom 4 (see FIGS. 2 and 3) with a sealing rib 4*a* accepted to bear against the end face 5*a* of the mouth of a bottle whose neck is shown at 5.

In addition, the double-lip seal 6 is provided to engage the wall 5*b* of the neck of the bottle adjacent the mouth. This double seal comprises an outer member 6*a* which is deflectible inwardly and hugs the wall 5*b*, a bight 6*b* and an inner member 6*c* which likewise increases the deflectibility of the seal and which is supported by a plate 6*d* against complete inward collapse. The sealing effectiveness can be increased by thrusting the plate 6*d* downwardly when the bottle is capped or by developing a vacuum within the bottle to draw this plate downwardly. In any event the double-lip seal can be considered to provide a self-sealing structure which can compensate for variations in the manufacturing tolerances of the bottle.

The cap 2 is formed with an outer member 7 which surrounds the neck of the bottle and is provided with an internal screwthread 8 which engages the complementary screw thread 9 of the bottle neck. Instead of the screwthreads, a bayonet can be provided.

On its outer face the cylindrical member 7 of the cap is formed with an annular array of ribs 10 extending parallel to one another and parallel to the axis of the cap, i.e. longitudinally. The skirt or sleeve 3 is provided with a safety ring 12. In this embodiment the ring 12 has an inwardly turned frangible web 12*a* which can be bent inwardly as the ring is thrust over a shoulder 13 of the neck of the bottle and then can spring outwardly to engage behind the face 13*a* which can be beveled at 13*b* to allow the ring to be forced thereover. The ring 12 is connected to the lower end of the sleeve 3 by a frangible web 14 which is readily ruptured to separate the ring from the sleeve.

The sleeve 3 is formed at its upper end, opposite that provided with the ring 12, internally with an array of longitudinal grooves 15 complementary to the ribs 10 and adapted to receive these ribs. The zone of the sleeve provided with these grooves is flanked by a pair of shoulders 16 and 17 which axially limit relative displacement of the two members of the closure by engaging the opposite sides of the ring 10. These rings project internally from the sleeve 3.

In addition at its exterior opposite of ring 12, a sleeve is provided with an internal chamfer 18 which enables the end 7*a* of member 7 to be inserted into the sleeve when the two are assembled.

The outer surface of the sleeve 3 may be knurled or milled as shown at 19 to facilitate gripping by the user. This milling may provide longitudinal grooves or ribs.

Once the tube parts 2 and 3 of the closure are fabricated, they are assembled by inserting the cap into the sleeve as noted.

This insertion causes the ribs 10 to project into the grooves 15 and to be locked between the shoulders 16 and 17 so that neither relative translatory or relative rotational movement between the two parts is permitted. After assembly into the position shown in FIG. 2 the cap is sealed on a bottle or other container and assumes the position shown in FIG. 2.

For opening of the vessel, the assembly is unscrewed, thereby shifting member 2 and 3 axially upwardly (FIG. 3) and separating the ring 12 as shown. After the first opening, the vessel can be closed again by simply screwing the assembly back in space, the original opening operation being signaled by the fact that the ring 12 has separated from the sleeve 3.

Naturally, the invention is susceptible to modification within the perspective and scope of the compounded claims by, for example, utilizing other means than the screw connection to connect the assembly to the bottle, e.g. a snap or force fit.

We claim:

1. A tamperproof closure for the mouth of a container provided with a neck surrounding this mouth and formed with an external shoulder, said closure comprising:

a cap formed from synthetic resin and of cup-shaped configuration, said cup being provided at the bottom with means sealingly engaging said neck at said mouth, and an outer member connected to said bottom surrounding said neck, said neck and said outer member being provided with formations for releasably engaging said outer member and said neck, said member being formed externally with an annular array of ribs; and a sleeve surrounding said outer member and said neck, said sleeve being generally cylindrical and formed of synthetic resin while being provided at a lower end with a safety ring connected by at least one frangible ligature to said sleeve, said ring being engageable by said shoulder of said neck for separation of said ring from said sleeve upon removal of said cap from said container, said sleeve being formed with an annular array of grooves complementary to and receiving said ribs, and with inwardly directed shoulders flanking said ribs and axially coupling said cap to said sleeve.

2. The closure defined in claim 1 wherein said sleeve at said end opposite said ring is formed with an internal bight facilitating insertion of the outer member into said sleeve.

3. The closure defined in claim 2, further comprising a ribbed surface formed on the exterior of said sleeve.

4. The closure defined in claim 3 wherein said bottom is provided with an annular rib engaging an end face of said container around said mouth.

5. The closure defined in claim 4 wherein said bottom is provided with a double-lipped seal received within said neck and hugging a neck wall therein adjacent said mouth.

6. The closure defined in claim 5 wherein said double-lipped seal comprises a pair of flexible members connected by a bight and a plate inwardly of said members.

7. The closure defined in claim 6 wherein said flexible members, said bight, said plate, said bottom and said outer member are molded unitarily with one another.

8. The closure defined in claim 1 wherein said ring is provided with an inwardly directed lip adapted to be deflected by said shoulder of said neck upon insertion of said ring over said neck and to spring outwardly behind said shoulder of said neck.

9. The closure defined in claim 2 wherein said ring is provided with an inwardly directed lip adapted to be deflected by said shoulder of said neck upon insertion of said ring over said neck and to spring outwardly behind said shoulder of said neck.

10. The closure defined in claim 3 wherein said ring is provided with an inwardly directed lip adapted to be deflected by said shoulder of said neck upon insertion of said ring over said neck and to spring outwardly behind said shoulder of said neck.

11. The closure defined in claim 4 wherein said ring is provided with an inwardly directed lip adapted to be deflected by said shoulder of said neck upon insertion of said ring over said neck and to spring outwardly behind said shoulder of said neck.

12. The closure defined in claim 5 wherein said ring is provided with an inwardly directed lip adapted to be deflected by said shoulder of said neck upon insertion of said ring over said neck and to spring outwardly behind said shoulder of said neck.

* * * * *